US009101194B2

(12) United States Patent
Ishida

(10) Patent No.: US 9,101,194 B2
(45) Date of Patent: Aug. 11, 2015

(54) ROD-SHAPED COSMETIC MATERIAL FEEDING CONTAINER

(75) Inventor: Yukikazu Ishida, Kawaguchi (JP)

(73) Assignee: TOKIWA CORPORATION, Gifu (JP)

( * ) Notice: Subject to any disclaimer, the term of this patent is extended or adjusted under 35 U.S.C. 154(b) by 613 days.

(21) Appl. No.: 13/457,856

(22) Filed: Apr. 27, 2012

(65) Prior Publication Data

US 2012/0288321 A1 Nov. 15, 2012

(30) Foreign Application Priority Data

May 11, 2011 (JP) ..... 2011-106487

(51) Int. Cl.
*A45D 40/20* (2006.01)
*A45D 40/04* (2006.01)
*A45D 40/06* (2006.01)

(52) U.S. Cl.
CPC ..... *A45D 40/205* (2013.01); *A45D 40/04* (2013.01); *A45D 40/06* (2013.01)

(58) Field of Classification Search
USPC ..... 401/70, 75, 172, 173, 174
See application file for complete search history.

(56) References Cited

U.S. PATENT DOCUMENTS 3,358,699 A * 12/1967 Bau ..... 401/70
5,131,773 A * 7/1992 Gueret ..... 401/68
5,573,341 A * 11/1996 Iaia ..... 401/172
6,481,909 B2 * 11/2002 Lee ..... 401/116
7,736,079 B2 6/2010 Tani

FOREIGN PATENT DOCUMENTS

CN 1432320 A 7/2003
JP 2000262324 A 9/2000

OTHER PUBLICATIONS

Chinese Examination Report dated May 13, 2014, issued in corresponding Chinese Application No. 201210144300.8.

* cited by examiner

*Primary Examiner* — David Walczak
(74) *Attorney, Agent, or Firm* — Bacon & Thomas, PLLC

(57) ABSTRACT

A rod-shaped cosmetic material feeding container has a container front portion and a container rear portion which are relatively rotatable in a delivering direction. A piston body is slidably inserted in a closely attached state to an inner portion of the container front portion. A moving body is arranged in a rear side of the piston body within the container rear portion and is provided in an outer periphery with the male thread connecting by screw to a female thread provided within the container rear portion. The piston body and the moving body are separated so as not to be engaged to each other, thereby a cosmetic material can be directly filled in a melting state from an opening portion in a leading end of the container in a state in which only the piston body is arranged at a predetermined position within the container front portion.

2 Claims, 12 Drawing Sheets

ROD-SHAPED COSMETIC MATERIAL FEEDING CONTAINER

BACKGROUND OF THE INVENTION

1. Field of the Invention

The present invention relates to a rod-shaped cosmetic material feeding container which delivers a rod-shaped cosmetic material.

2. Description of the Conventional Art

As a rod-shaped cosmetic material feeding container which delivers a rod-shaped cosmetic material there has been known such a structure as disclosed in Japanese Unexamined Patent Publication No. 2006-305318. The rod-shaped cosmetic material feeding container described in the patent document is provided with a leading tube, a main body tube which is connected to the leading tube, a tubular pipe member which is arranged within the leading tube and is open in both ends, a rod-shaped cosmetic material which is filled in the pipe member and is closely attached to the pipe member, a rod-shaped moving body which has a piston inserted slidably into the pipe member in a closely attached state in a leading end, has a male thread in an outer periphery in a rear side of the piston and is arranged within the container, and a female thread which is provided within the container and is connected by screw to the male thread of the moving body, and is structured such that if the leading tube and the main body tube are relatively rotated in a feeding direction, the moving body moves forward on the basis of a screwing action of the male thread and the female thread, and the rod-shaped cosmetic material appears from the opening portion in the leading end of the container in accordance with a forward movement of the piston. The rod-shaped cosmetic material is filled and formed in a front side of the piston by directly injecting a rod-shaped cosmetic material forming material in a melting state into the pipe member so as to cool and solidify.

In this case, a positioning of the piston within the pipe member in the case that the rod-shaped cosmetic material forming material in the melting state is injected into the pipe member is carried out by adjusting a position of the moving body within the container while screwing the male thread of the moving body with the female thread within the container.

However, it is hard to accurately position the moving position while screwing (rotating) the thread as mentioned above, and the position of the piston is accordingly deviated. As a result, a filling amount of the rod-shaped cosmetic material forming material in the melting state within the pipe member does not become constant, and there is such a problem that a length of the formed rod-shaped cosmetic material fluctuates, and a dispersion is generated in a quality. Particularly, in the case of the rod-shaped cosmetic material having a small diameter, the length thereof is widely differentiated in accordance with somewhat of filling amount difference.

SUMMARY OF THE INVENTION

Accordingly, an object of the present invention is to provide a rod-shaped cosmetic material feeding container which can be filled with a fixed amount of cosmetic material, thereby to prevent a filling defect, and achieve stability of a quality.

In accordance with the present invention, there is provided a rod-shaped cosmetic material feeding container comprising:

a container front portion which is formed as a tubular shape being open in both ends;

a rod-shaped cosmetic material formed by being directly filled with a cosmetic material in an inner portion of the container front portion, and attached to the inner portion of the container front portion;

a piston body provided to be slidable in the inner portion in a closely attached state;

a container rear portion which is relatively rotatable with respect to the container front portion;

a moving body which is arranged in a rear side of the piston body within the container rear portion and is provided with a male thread in an outer periphery; and a female thread which is provided within the container rear portion and is connected by screw to the male thread;

wherein the rod-shaped cosmetic material feeding container is structured such that when the container front portion and the container rear portion are relatively rotated in a feeding direction, a screwing action of the male thread and the female thread works, the moving body moves forward, and the rod-shaped cosmetic material appears from an opening portion in a leading end of the container in accordance with a forward movement of the piston body, and wherein the piston body and the moving body are separated so as to be non-engaged to each other.

In accordance with the rod-shaped cosmetic material feeding container mentioned above, since the piston body which is slidably inserted to the inner portion in the front portion of the container in the closely attached state, and the moving body in the rear side thereof are separated and are not engaged, it is possible to be filled with the cosmetic material in the melting state directly in the inner portion from the opening portion in the leading end of the container, in a state in which only the piston body is arranged at a predetermined position (a position in an initial state) within the front portion of the container, and it is possible to be filled with a fixed amount of cosmetic material in the front side of the piston body without being affected by the moving body (without depending on the moving body). As a result, a filling defect can be prevented, and it is possible to achieve stability of a quality.

In this case, when the piston body is provided in a rear end surface thereof with a concave portion which is concaved toward a front side, and the moving body is provided in a leading end surface thereof with a convex portion which enters into the concave portion so as to come into contact therewith, the convex portion in the leading end surface of the moving body enters into the concave portion in the rear end surface of the piston body so as to come into contact on the basis of the forward movement of the moving body. Accordingly, the piston body moves forward straightly without being twisted by the concave and convex portions at a time of pushing out the rod-shaped cosmetic material which is closely attached to the inner portion of the front portion of the container and has a great resistance by the piston body, and the rod-shaped cosmetic material is well pushed out.

Further, when the piston body is also provided in a leading end surface thereof with a concave portion which is concaved toward a rear side and has the same shape as the concave portion mentioned above, it is possible to assemble even by reversing back and forth without depending any directionality. Accordingly, it is possible to improve an assembling property.

Further, when the piston body has an annular convex portion which is closely attached to the inner portion of the front portion of the container so as to slide at each of positions which are separated in an axial direction of an outer peripheral surface thereof, the piston body straightly moves forward without being twisted on the basis of the annular convex portions which are provided side by side so as to be separated in the axial direction, at a time of pushing out the rod-shaped cosmetic material by the piston body, and the rod-shaped cosmetic material is further well pushed out.

As mentioned above, in accordance with the present invention, since a fixed amount of cosmetic material can be filled, it is possible to provide the rod-shaped cosmetic material feeding container which can prevent a filling defect, and can achieve stability of a quality.

DETAILED DESCRIPTION OF PREFERRED EMBODIMENTS

Figure 1:
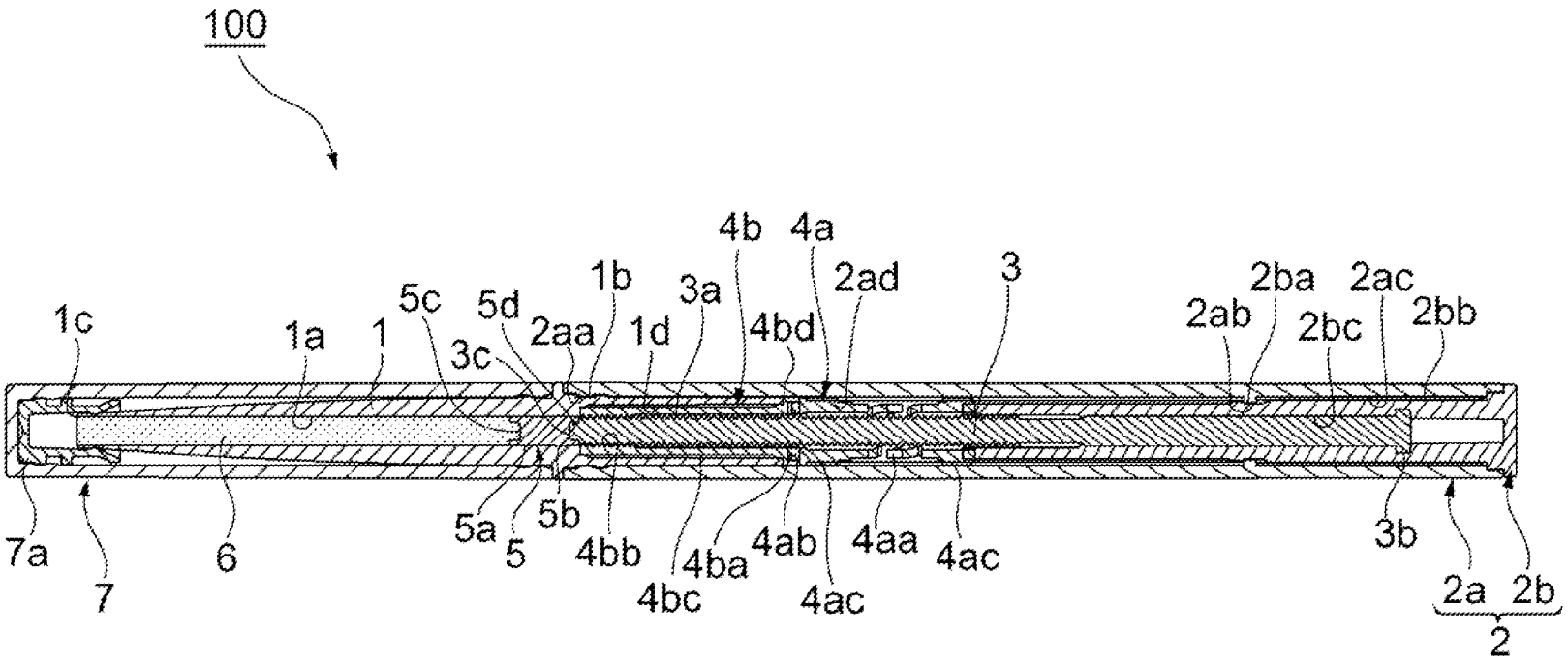
FIG. 1 is a longitudinal cross sectional view showing an initial state of a rod-shaped cosmetic material feeding container in accordance with a first embodiment of the present invention.

A description will be in detail given below of embodiments in accordance with the present invention with reference to the accompanying drawings. In this case, the same reference numerals are attached to the same or corresponding elements, and an overlapping description will be omitted.

Figure 10:
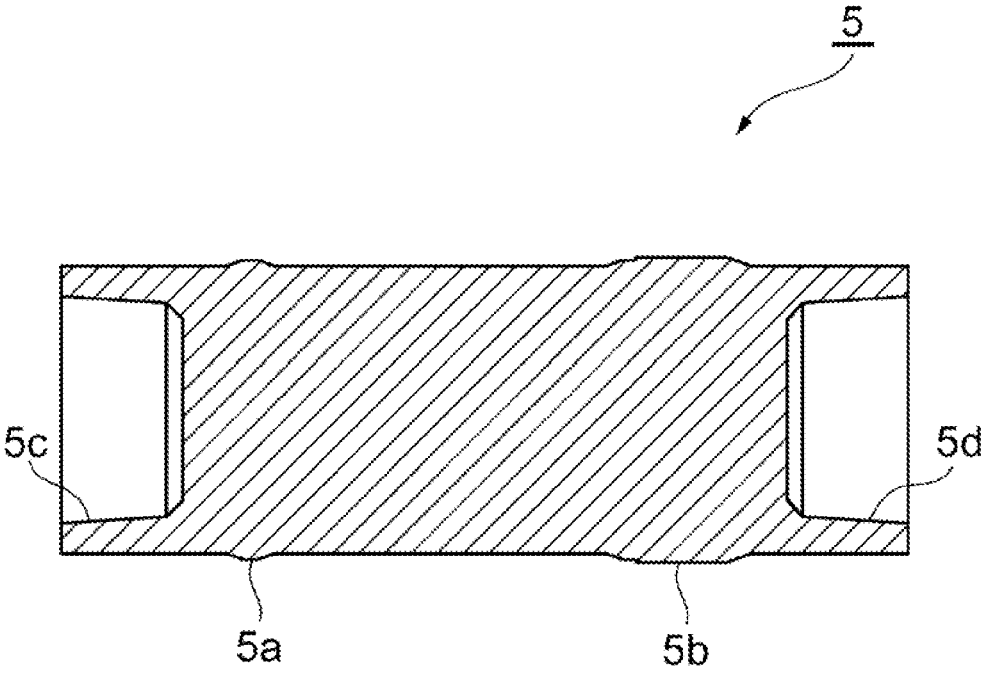
FIG. 10 is a longitudinal cross sectional view of the piston body shown in FIG. 9.
Figure 11:
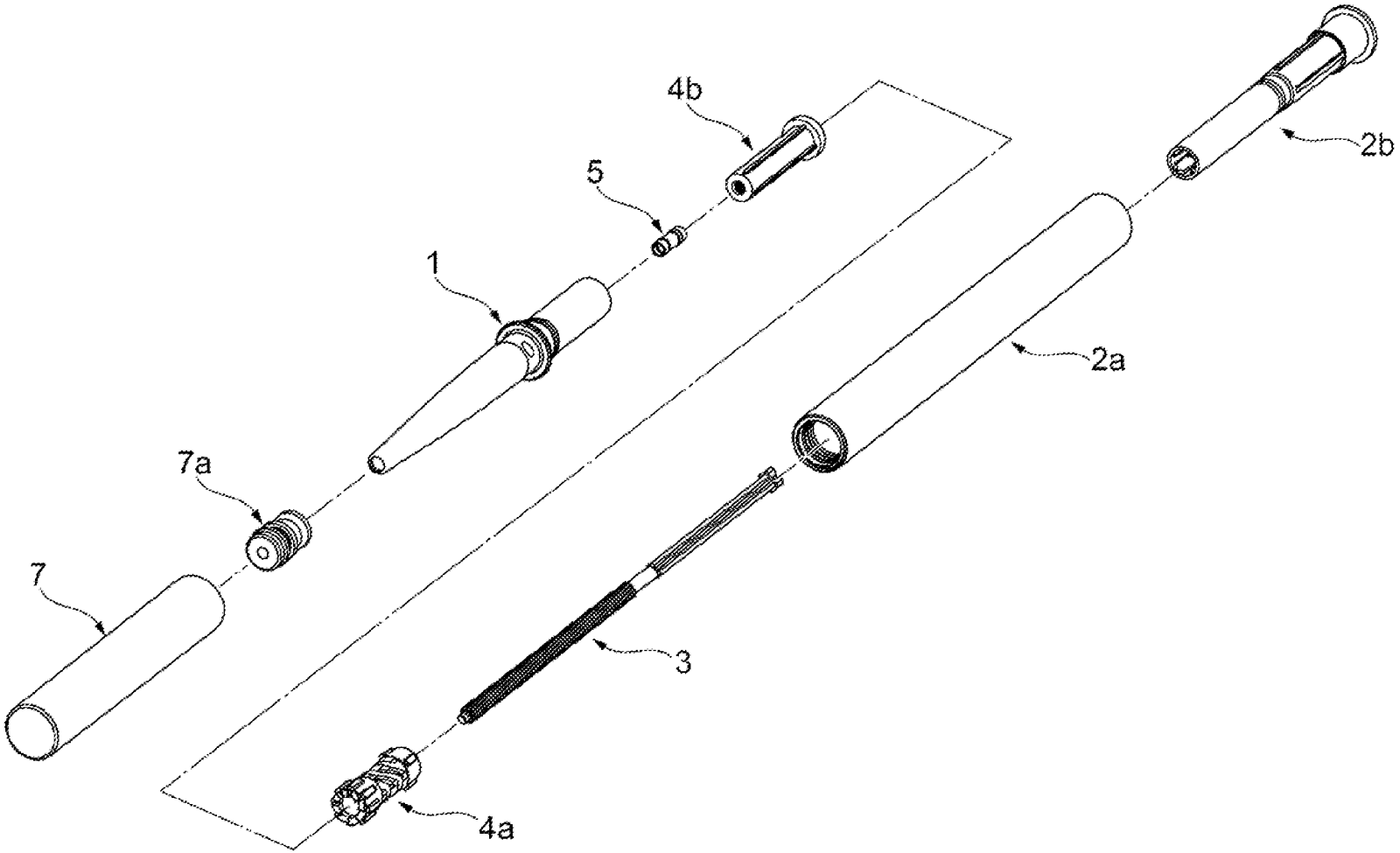
FIG. 11 is an exploded perspective view of the rod-shaped cosmetic material feeding container shown in FIG. 1.
Figure 12:
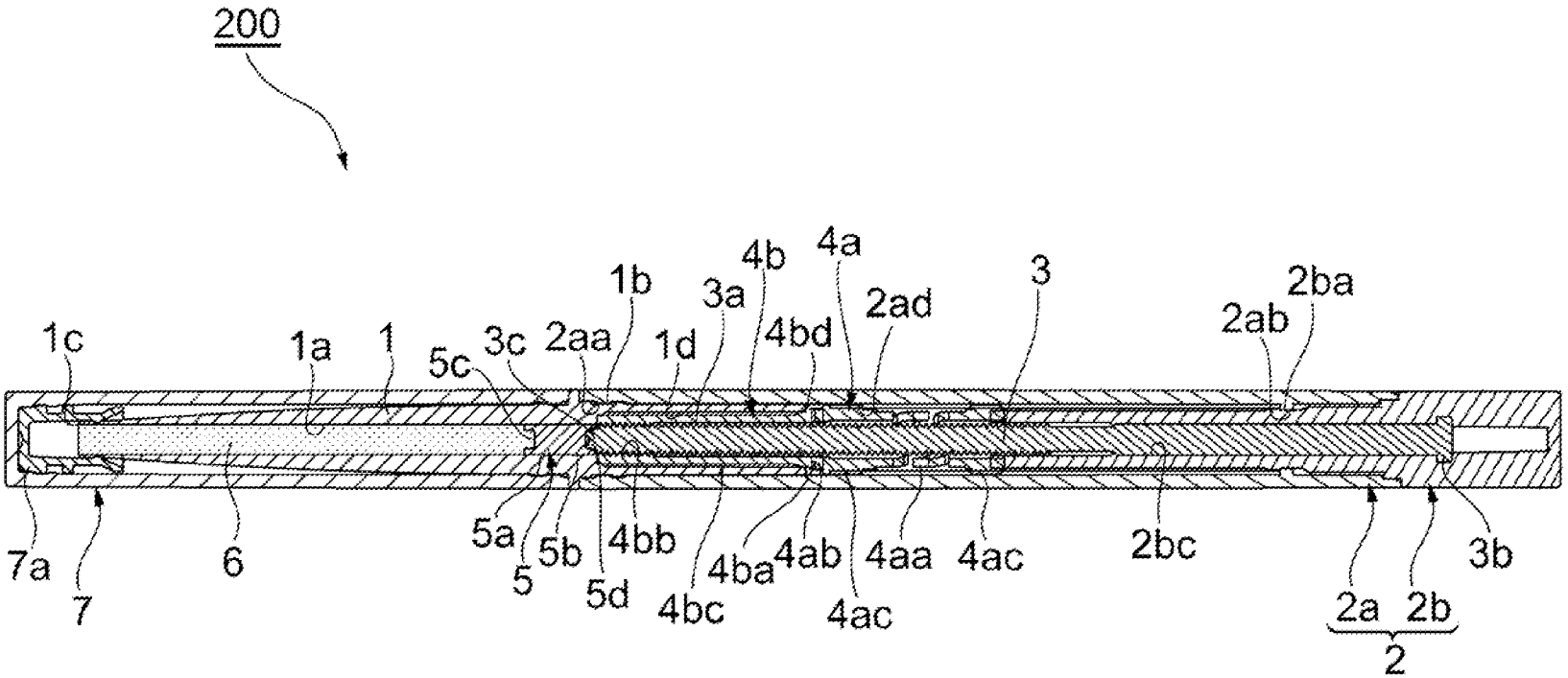
FIG. 12 is a longitudinal cross sectional view showing an initial state of a rod-shaped cosmetic material feeding container in accordance with a second embodiment of the present invention.
Figure 13:
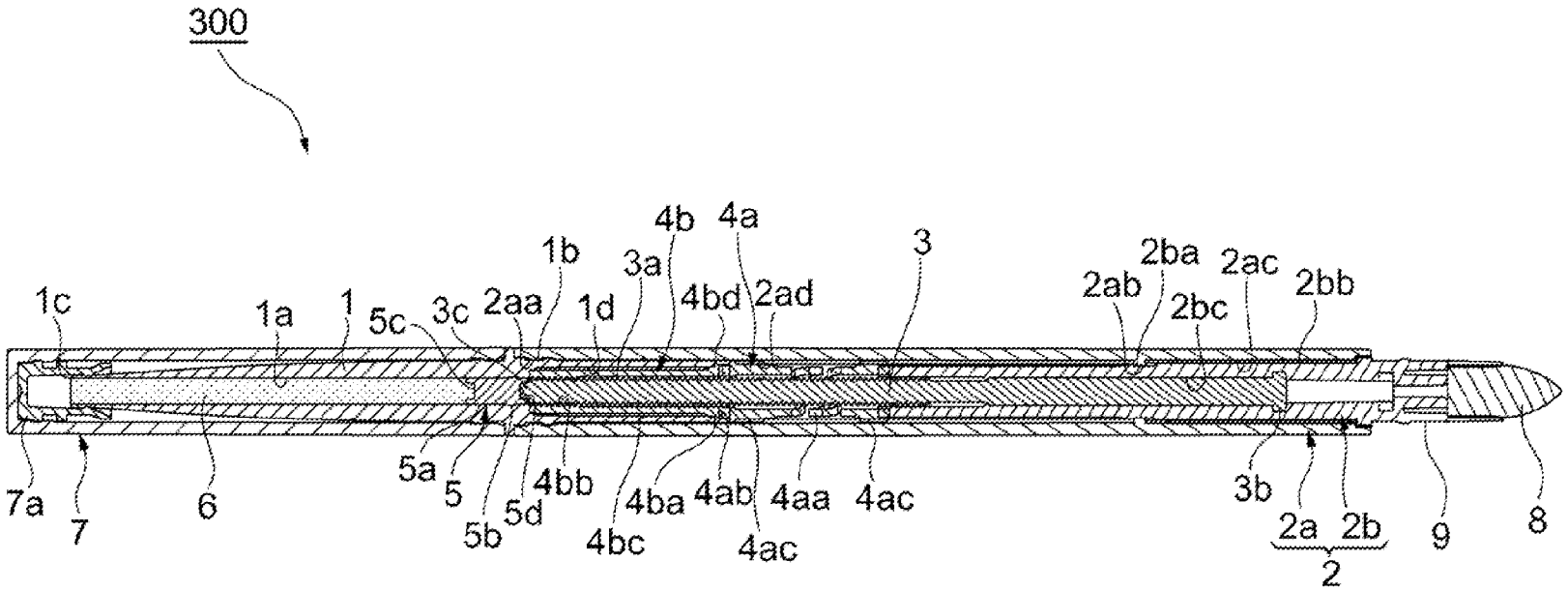
FIG. 13 is a longitudinal cross sectional view showing a rod-shaped cosmetic material feeding container in accordance with a third embodiment of the present invention.

FIG. 1 to FIG. 11 show a first embodiment in accordance with the present invention, FIG. 12 shows a second embodiment in accordance with the present invention, and FIG. 13 shows a third embodiment in accordance with the present invention, respectively. First of all, a description will be given of the first embodiment shown in FIG. 1 to FIG. 11.

Figure 2:
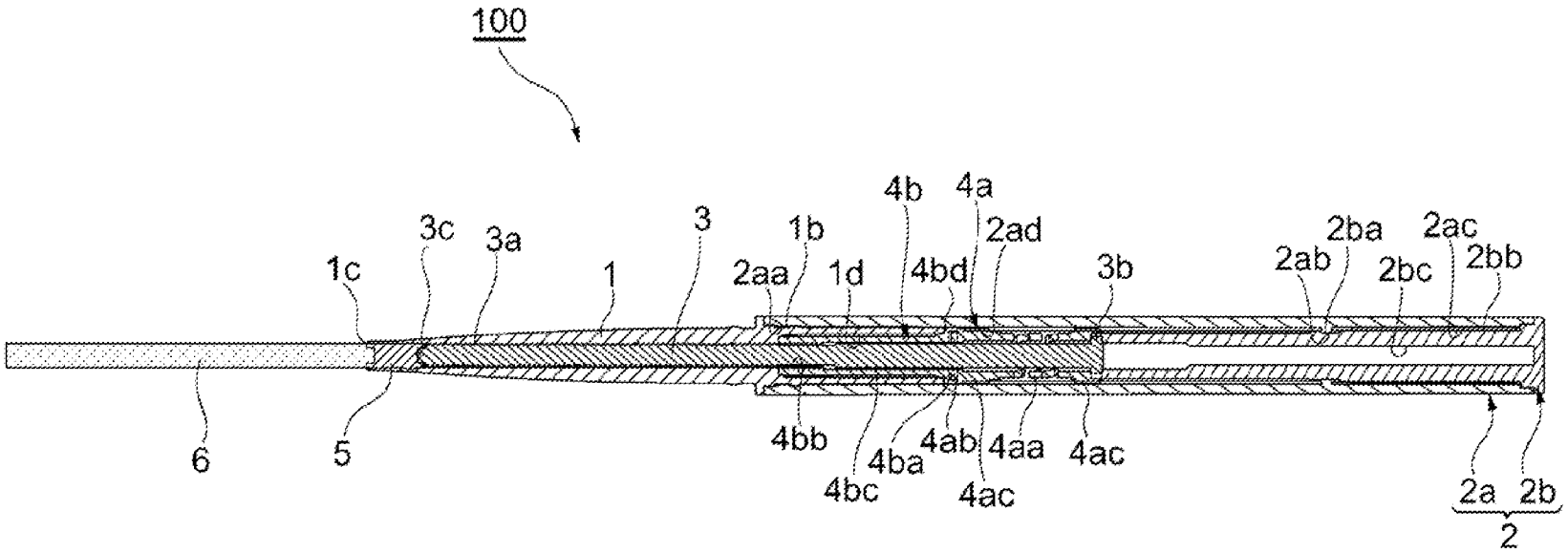
FIG. 2 is a longitudinal cross sectional view at a time when an airtight cap is detached from a state shown in FIG. 1, and a moving body and a piston body move forward to a forward moving limit by a user.
Figure 3:
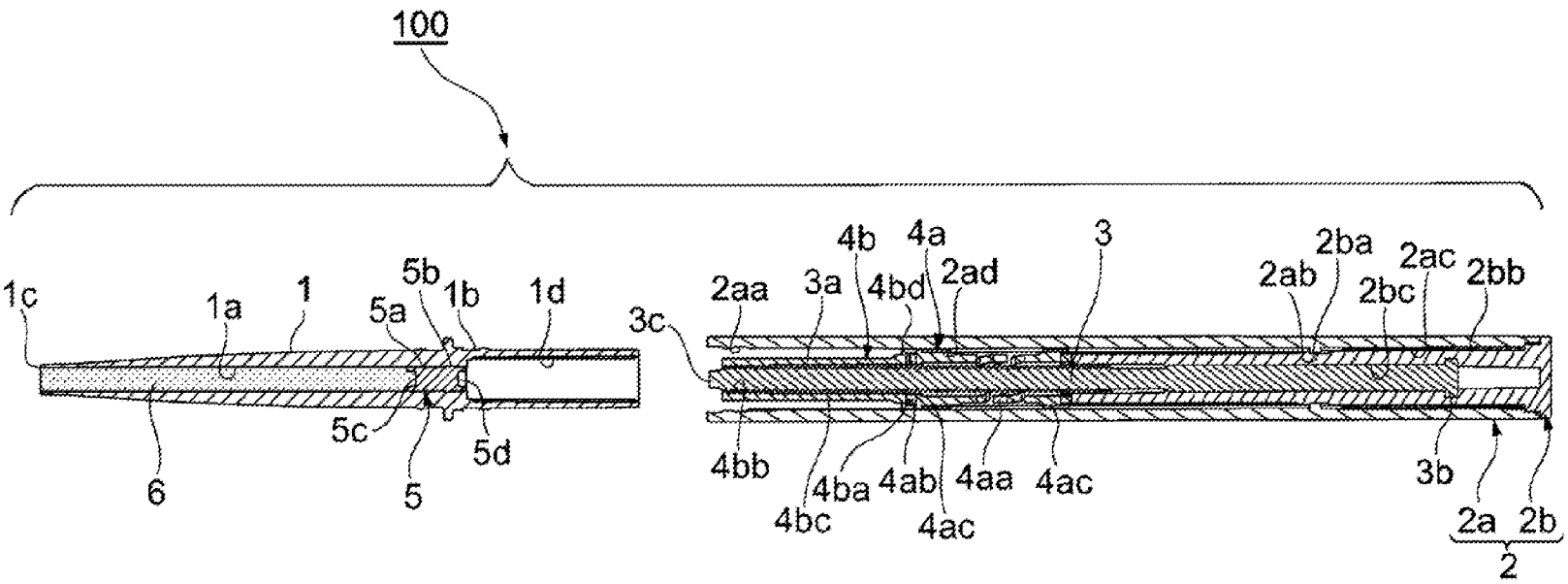
FIG. 3 is a longitudinal cross sectional view showing a state in which the airtight cap is detached from the state shown in FIG. 1, and before a container main body and a leading tube are engaged.
Figure 4:
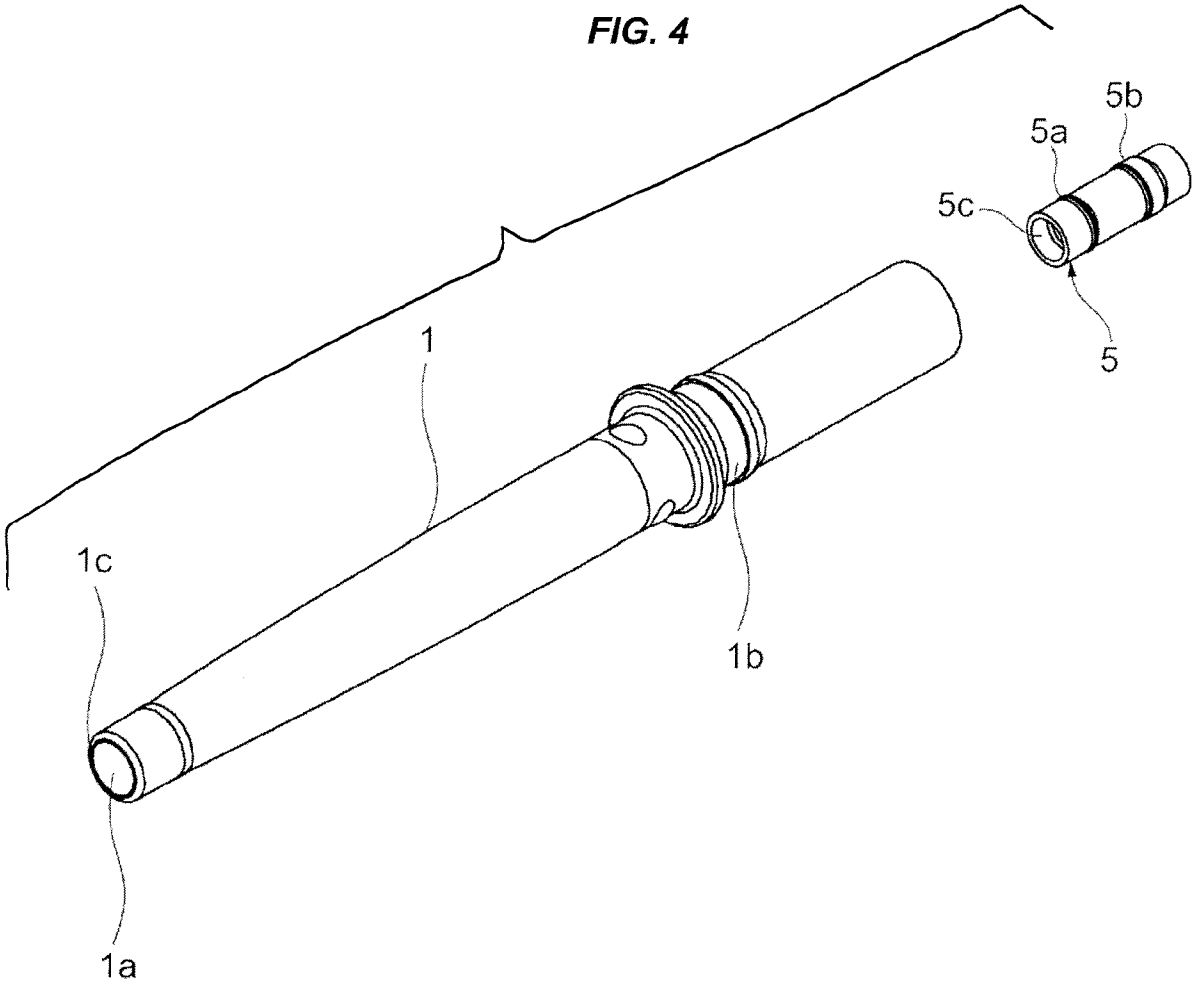
FIG. 4 is a perspective view showing the leading tube and a piston body in FIG. 1 to FIG. 3.
Figure 5:
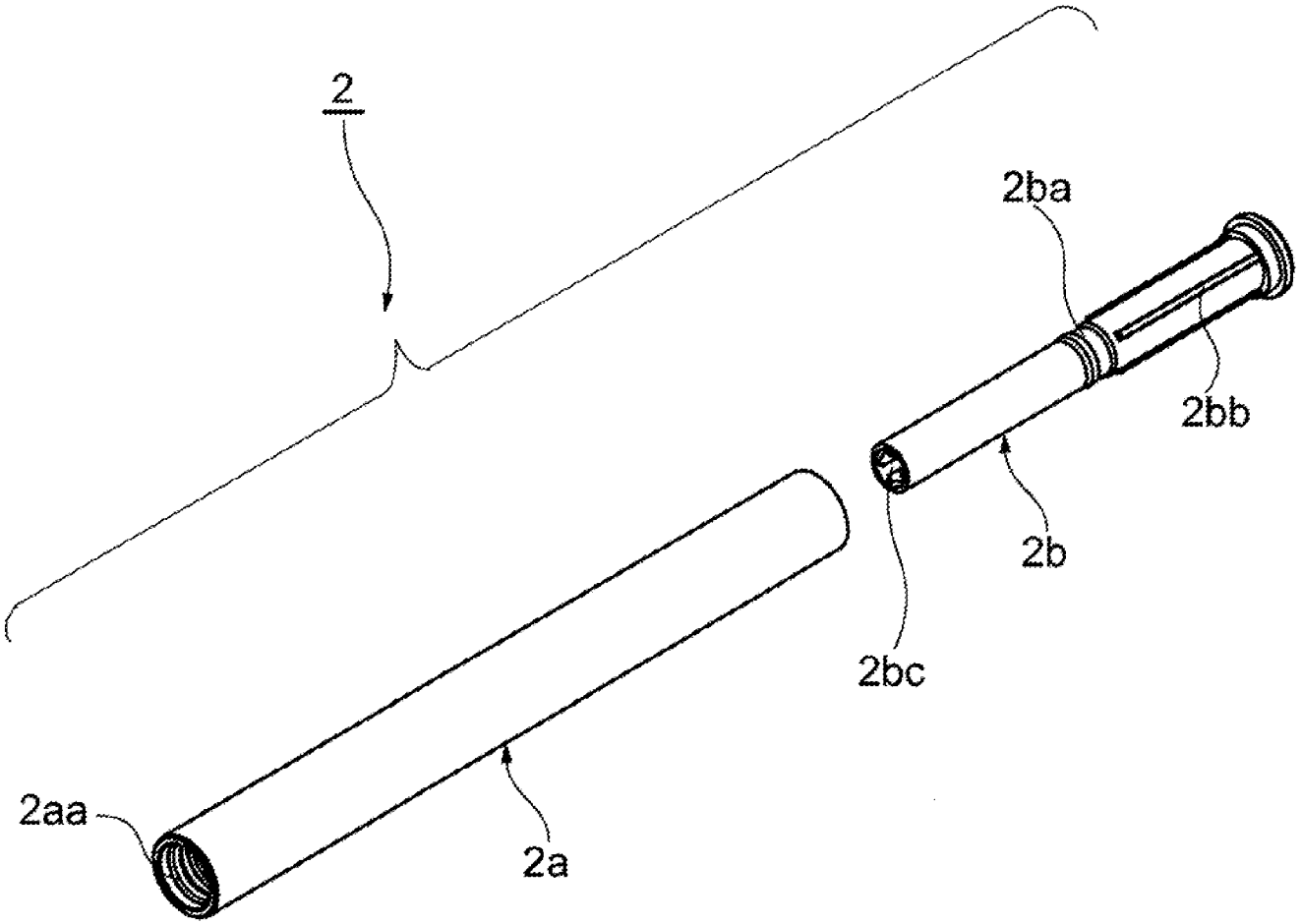
FIG. 5 is a perspective view showing the container main body at a time when a main body tube and a rotation stop in FIG. 1 to FIG. 3 are separated.
Figure 6:
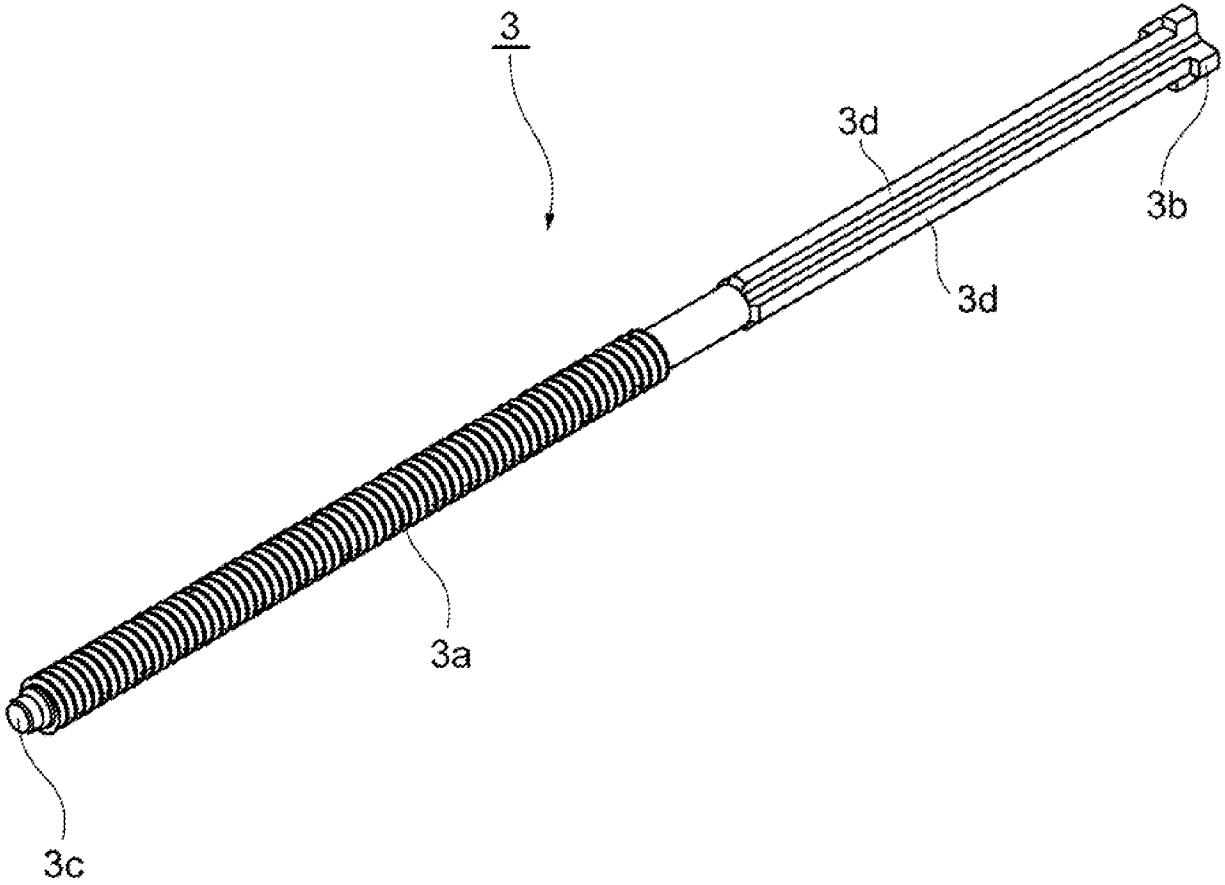
FIG. 6 is a perspective view showing a moving body in FIG. 1 to FIG. 3.
Figure 7:
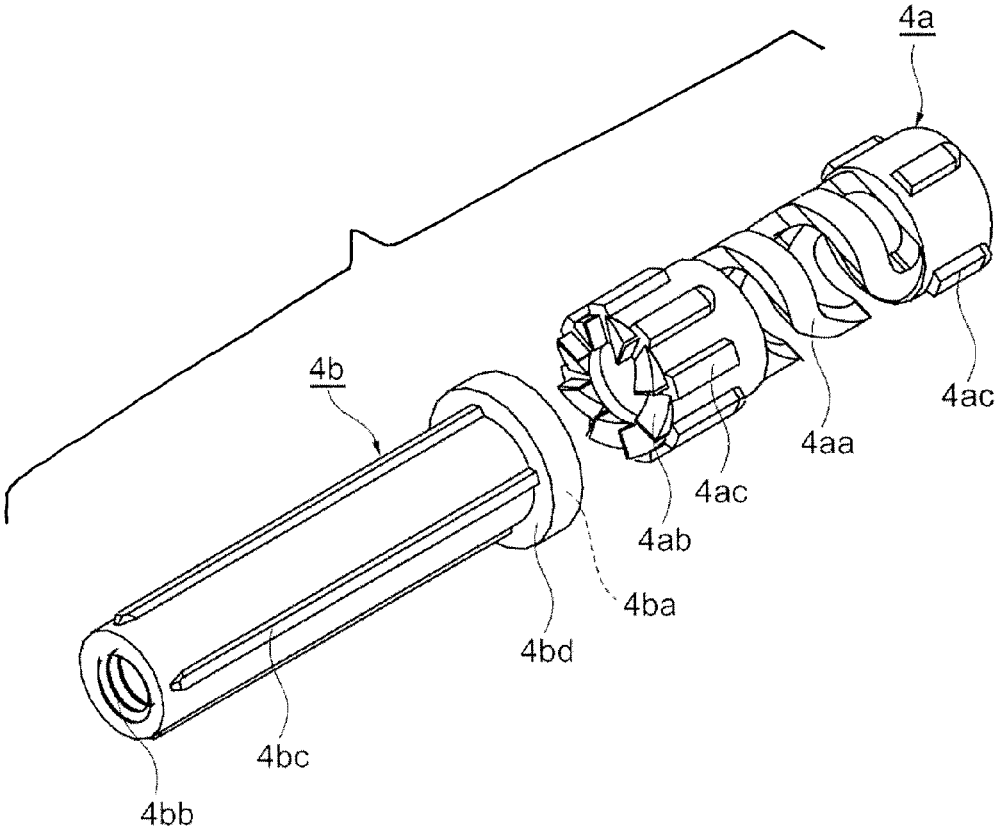
FIG. 7 is a perspective view showing a female thread member and a spring member in FIG. 1 to FIG. 3.
Figure 8:
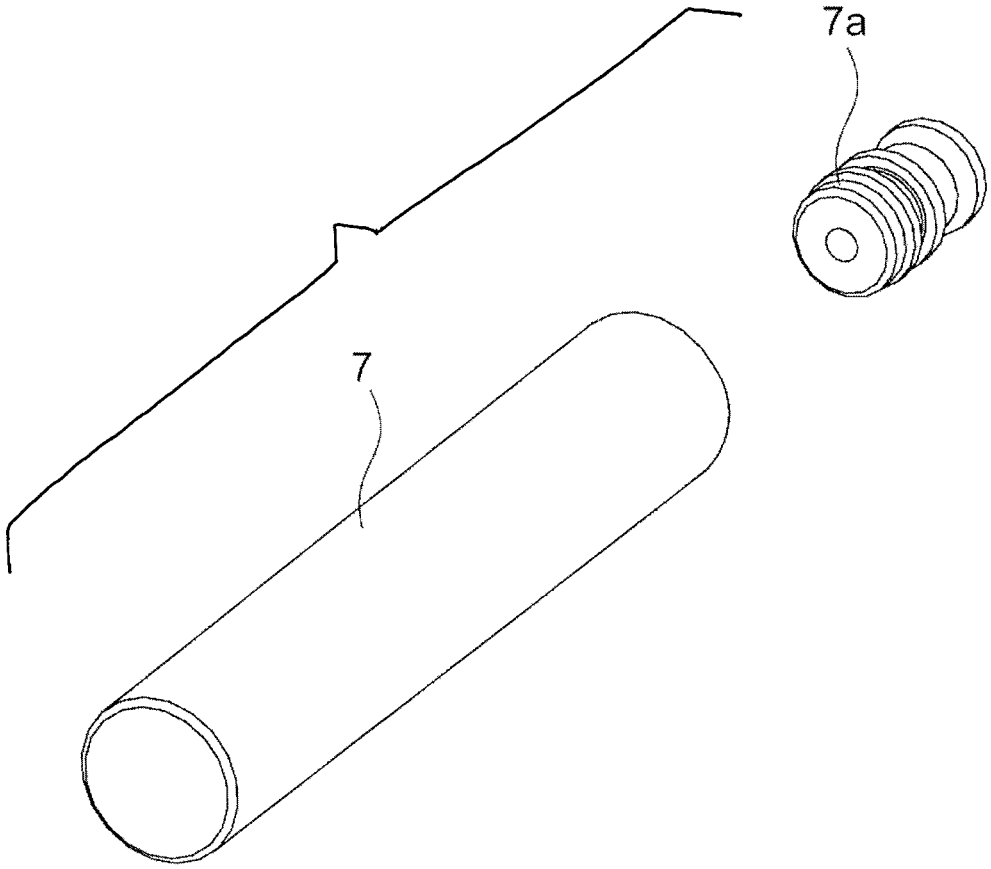
FIG. 8 is a perspective view showing an airtight cap and an inner lid in FIG. 1.
Figure 9:
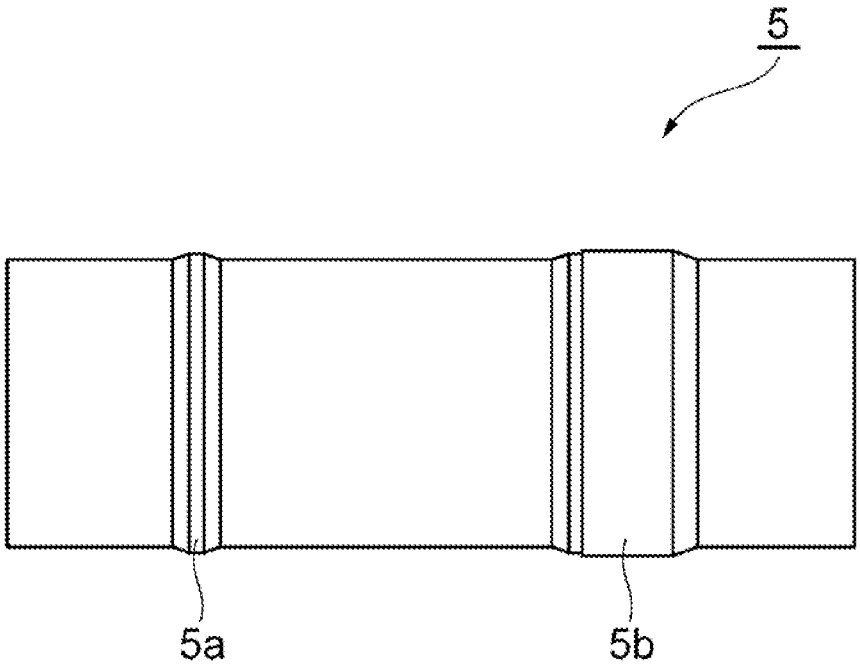
FIG. 9 is a side elevational view showing the piston body in FIG. 1 to FIG. 3.

FIG. 1 to FIG. 3 are longitudinal cross sectional views showing respective states of a rod-shaped cosmetic material feeding container in accordance with the first embodiment of the present invention, FIG. 4 is a perspective view of a leading tube and a piston body, FIG. 5 is a perspective view of a main body tube and a rotation stop which construct a container main body, FIG. 6 is a perspective view of a moving body, FIG. 7 is a perspective view of a female thread member and a spring member, FIG. 8 is a perspective view of an airtight cap and an inner lid, FIG. 9 is a side elevational view of the piston body, FIG. 10 is a longitudinal cross sectional view of the piston body, FIG. 11 is an exploded perspective view of the rod-shaped cosmetic material feeding container, and the rod-shaped cosmetic material feeding container in accordance with the present invention accommodates a volatile rod-shaped cosmetic material for a gel eyeliner and can appropriately deliver it on the basis of an operation of a user.

As shown in FIG. 1 to FIG. 3, a rod-shaped cosmetic material feeding container 100 is provided as an outer shape structure with a tubular leading tube (a container front portion) 1 which is open in both ends, and a container main body (a container rear portion) 2 which can attach and detach the leading tube 1 by inserting a rear portion of the leading tube 1 into a front portion thereof, and is engaged so as to be relatively rotatable.

In this case, in the present invention, a description will be given on the assumption that the leading tube 1 can be replaced, however, the leading tube 1 can not be replaced, that is, the leading tube 1 can not move in an axial direction after it is engaged with the container main body 2.

In the rod-shaped cosmetic material feeding container 100 in accordance with the present embodiment, the leading tube 1 is engaged with the container main body 2 at such a degree that it does not break away in the axial direction at a relative rotating time with the container main body 2, and it is possible to draw out the leading tube 1 if a certain degree of force is applied in the axial direction at a time of replacing the leading tube 1.

Further, the rod-shaped cosmetic material feeding container 100 is approximately provided in an inner portion with a rod-shaped cosmetic material 6 which is accommodated in the leading tube 1, a piston body (a pressing portion) 5 which is closely attached into the leading tube 1 and can slide in an inner portion, a female thread member 4*b* which is inserted to the leading tube 1 so as to be synchronously rotatable with the leading tube 1, a spring member (a click member) 4*a* which is inserted into the container main body 2 so as to be synchronously rotatable with the container main body 2 and is engaged by click with the female thread member 4*b*, a moving body 3 which can be connected by screw to the female thread member 4*b* and stops its forward movement if it moves forward to a predetermined forward moving limit on the basis of a relative rotation between the leading tube 1 and the container main body 2, a main body tube 2*a* which constructs the container main body 2, inserts the leading tube 1 to a front portion thereof and accommodates the spring member 4*a* and the female thread member 4*b*, and a rotation stop 2*b* which is engaged with the main body tube 2*a* so as to be immobile in the axial direction and be synchronously rotatable and into which the moving body 3 is inserted so as to be synchronously rotatable.

In this case, a description will be given below on the assumption that a direction of a relative rotation between the leading tube 1 and the container main body 2 corresponding to a sliding operation which is carried out for propelling the moving body 3 in a forward moving direction is a delivering direction.

The leading tube 1 is formed as a tubular shape which is open in both ends, as shown in FIG. 1 to FIG. 4, and has such an outer appearance that a front portion thereof is formed as a tapered shape heading for a leading end opening portion 1*c* provided in a leading end. Further, an outer periphery of a rear portion of the leading tube 1 in accordance with the present embodiment is annularly provided with a concave portion 1*b* by which the leading tube 1 is engaged with the main body tube 2*a* of the container main body 2 so as to be detachable and be relatively rotatable, and this rear portion is inserted into the main body tube 2*a*.

Further, an accommodating portion 1*a* which accommodates the rod-shaped cosmetic material 6 is provided in an inner portion of a front portion of the leading tube 1, and the slidable piston body 5 is accommodated so as to be closely attached into the accommodating portion 1*a*. Further, the female thread member 4*b* is inserted into an inner portion of a rear portion of the leading tube 1, and a plurality of protrusions 1*d* which extend in the axial direction for engaging with the female thread member 4*b* so as to be synchronously rotatable are provided along a peripheral direction.

The rod-shaped cosmetic material 6 within the accommodating portion 1*a* is a gel state rod-shaped cosmetic material which is used for an eyeliner, and includes a cosmetic volatile oil. A weight of the cosmetic material is 0.15 g, and includes the cosmetic volatile oil at a rate between 10% and 50%.

Further, the rod-shaped cosmetic material 6 having a volatility is formed by being directly filled in the accommodating portion 1*a* of the leading tube 1, and is accommodated by being closely attached into the leading tube 1.

In this rod-shaped cosmetic material 6, a diameter thereof is a small diameter between 0.9 mm and 2.5 mm, and more preferably between 1.2 mm and 2.5 mm. It is set to the small diameter (which is equal to or less than 2.5 mm), for drawing a narrow line, for example, drawn by an ink brush, a comb or the like.

A measured hardness by a penetration test of the rod-shaped cosmetic material 6 is between 0.1 and 2 (N), and more preferably between 0.15 and 1.5 (N). Further, on the basis of the hardness mentioned above, a softness as the gel eyeliner can be sufficiently retained. In this case, the hardness of the rod-shaped cosmetic material 6 is a hardness which is measured by using "FUDOH rheometer" RHEOTECH Co., Ltd. As a measuring method, it measures a peak value which is generated in the rod-shaped cosmetic material 6 at a time of inserting a columnar applicator having a diameter of 1 mm into the rod-shaped cosmetic material 6 by a depth of 10 mm at a velocity of approach 6 cm/min under a condition of a measuring temperature of 25° C. The measuring method mentioned above is a general measuring method which is used for measuring a hardness in the cosmetic material.

The piston body 5 is formed, for example, by a thermoplastic elastomer (TPE) or the like, and is constructed as a columnar shape as shown in FIG. 1 to FIG. 4, FIG. 9 and FIG. 10. A concave portion 5*d* which is concaved toward a front side is formed in a rear end surface of the piston body 5, and a concave portion 5*c* which is concaved toward a rear side and has the same shape as the concave portion 5*d* is formed in a leading end surface. These concave portions 5*c* and 5*d* are inverse directed, however, are formed as such a shape as to coincide with a circulated truncated cone shaped leading end (a convex portion) 3*c* mentioned below of the moving body 3, and a tubular inner peripheral surface is formed as a smaller diameter in an inner side in an axial direction and as a larger diameter in an outer side, and is structured such as to be gently inclined with respect to an axis of the piston body 5. Further, the leading end 3*c* mentioned below of the moving body 3 moves forward and comes into contact with respect to the concave portion 5*d* in the rear side.

Further, an outer peripheral surface of the piston body 5 is provided with each of annular convex portions 5*a* and 5*b* so as to be spaced in an axial direction. These annular convex portions 5*a* and 5*b* are closely attached to an inner peripheral surface of the accommodating portion 1*a*, and are structured such that a width (a width in the axial direction) of the annular convex portion 5*b* in a rear side is larger than a width of the annular convex portion 5*a* in a front side.

The piston 5 is provided so as to be closely attached into the accommodating portion 1*a*, thereby working with a motion of the moving body 3 so as to be pushed and move forward if the moving body 3 moves in a delivering direction, and plays a role in delivering the rod-shaped cosmetic material 6 within the accommodating portion 1*a* from the opening portion 1*c* of the leading tube 1.

Further, the annular convex portions 5*a* and 5*b* of the piston body 5 both have a function of keeping a closure by being closely attached to the inner peripheral surface of the accommodating portion 1*a*, however, the wider annular convex portion 5*b* in the rear side exclusively contributes to reservation of the closing performance, and the narrower annular convex portion 5*a* in the front side exclusively contributes to suppression of a torsion of the piston body 5 at a time of forward moving so as to correct an attitude (in detail mentioned later).

The container main body 2 is constructed by the main body tube 2*a* and the rotation stop 2*b*, as shown in FIG. 1 to FIG. 3 and FIG. 5, the rotation stop 2*b* is inserted from a rear end side of the main body tube 2*a*, and the rotation stop 2*b* is engaged so as to be immovable in the axial direction and be synchronously rotatable with respect to the main body tube 2*a*. Further, the moving body 3, the spring member 4*a* and the female thread member 4*b* are accommodated within the container main body 2.

The main body tube 2*a* is formed as a cylindrical shape in which both ends are opened, a rear portion of the leading tube 1 is inserted into a front portion thereof, and the rotation stop 2*b* is inserted to a rear portion of the main body tube 2*a*. Further, an inner peripheral surface of the front portion of the main body tube 2*a* in accordance with the present embodiment is provided annularly with a convex portion 2*aa* which can be engaged with the concave portion 1*b* of the leading tube 1 such that the leading tube 1 is engaged so as to be detachable and be relatively rotatable. Further, an inner peripheral surface of the front portion of the main body tube 2*a* is provided along a peripheral direction with a plurality of protrusions 2*ad* which extend in an axial direction for engaging the spring member 4*a* so as to be synchronously rotatable. Further, an inner peripheral surface of the rear portion of the main body tube 2*a* is provided annularly with an engagement projection 2*ab* for engaging the rotation stop 2*b* so as to be immovable in the axial direction, and is provided along a peripheral direction with a plurality of protrusions 2*ac* which extend in the axial direction for engaging the rotation stop 2*b* so as to be synchronously rotatable.

The rotation stop 2*b* is provided in an outer peripheral surface thereof with an engagement groove 2*ba* which is formed along a peripheral direction for engaging with the engagement projection 2*ab* of the main body tube 2*a*, and is provided along a peripheral direction with a plurality of protrusions 2*bb* which extend in the axial direction for engaging with the protrusions 2*ac* of the main body tube 2*a*. Further, the rear portion of the moving body 3 is inserted to the inner peripheral surface of the rotation stop 2*b*, and a plurality of rotation stop grooves (inner peripheral rotation stops) 2*bc* are provided over a whole length of an inner peripheral surface so as to be spaced in the peripheral direction, for engaging the moving body 3 so as to be synchronously rotatable and be movable in the axial direction.

The moving body 3 is formed as a rod shape as shown in FIG. 1 to FIG. 3 and FIG. 6, and is provided in an outer periphery of a front half portion thereof with a male thread 3*a* which allows a screw connection to the female thread member 4*b*. Further, an outer periphery of the rear end of the moving body 3 is provided with a rotation stop projection (an outer peripheral rotation stop) 3*b* for engaging with the rotation stop groove (the inner peripheral rotation stop) 2*bc* so as to be slidable in the axial direction and be non-rotatable in the peripheral direction at a time of inserting the moving body 3 into the rotation stop 2*b*.

Further, a front end of the moving body 3 is provided with the leading end 3*c* corresponding to the convex portion which has a smaller diameter in a front side and a larger diameter in a rear side and protrudes like a circular truncated cone shape. The leading end 3*c* is formed as such a shape as to coincide with the concave portions 5*c* and 5*d* (refer to FIG. 10) of the piston body 5 which is accommodated within the leading tube 1.

The piston body 5 is separated so as not to be engaged (not to be constrained) with respect to the moving body 3, and is structured such that if the moving body 3 moves forward, the leading end 3*c* of the moving body 3 moves forward to the concave portion 5*d* in the rear side of the piston body 5, and the piston body 5 moves forward by being pushed by the moving body 3.

The moving body 3 having the structure mentioned above is arranged within the container main body 2 in a state in which it is connected by screw to the female thread member 4*b*. At this time, the rear portion of the moving body 3 is inserted into the rotation stop 2*b*, and the rotation stop projection 3*b* and the rotation stop groove 2*bc* are engaged.

The spring member 4*a* is constructed by a click member, and is formed as a tubular shape in which both ends are opened, as shown in FIG. 1 to FIG. 3 and FIG. 7, a spiral shaped spring portion 4*aa* which is contracted in the axial direction so as to absorb a shock and has an elasticity is formed in an intermediate portion in the axial direction thereof, and a plurality of click projections 4*ab* are formed along a peripheral direction in a front portion in the axial direction in such a manner as to protrude to an outer side in the axial direction from one end (an end in a forward side) of the spring member 4*a*. As a shape of the click projection 4*ab*, it is formed as a right angled triangular shape which has an inclined surface inclined to one side and a surface extending vertically in the axial direction, as shown in FIG. 7. Further, the click projection 4*ab* can achieve a click engagement with the female thread member 4*b*. Further, a plurality of projections 4*ac* and 4*ac* which pinch the spring portion 4*aa* from both sides in the axial direction and extend in an axial direction of an outer peripheral surface are formed along a peripheral direction on the outer peripheral surface of the spring member 4*a*, and these protrusions 4*ac* are engaged with the protrusions 2*ad* which are provided in the inner peripheral surface of the main body tube 2*a* of the container main body 2, whereby the spring member 4*a* can synchronously rotate with the main body tube 2*a*.

The female thread member 4*b* is arranged within the main body tube 2*a* and is inserted into the leading tube 1, as shown in FIG. 1 to FIG. 3 and FIG. 7, and is provided in an inner peripheral of a leading end thereof with a female thread 4*bb* which is connected by screw to the male thread 3*a* of the moving body 3. Further, a plurality of protrusions 4*bc* extending in the axial direction are provided along the peripheral direction on the outer peripheral surface, and the protrusions 4*bc* are engaged with the protrusions 1*d* of the leading tube 1, whereby the leading tube 1 and the female thread member 4*b* can synchronously rotate. Further, a step portion (a collar portion) 4*bd* with which the rear end of the leading tube 1 comes into contact at a time of being inserted into the leading tube 1 is formed in a rear end of the female thread member 4*b*, and a click hole 4*ba* which can be engaged by click with the click projection 4*ab* of the spring member 4*a* is formed therein.

The spring member 4*a* and the female thread member 4*b* mentioned above are engaged by click, and are arranged within the container main body 2 in a state in which the moving body 3 is connected by screw to the female thread member 4*b* in the inner sides of the spring member 4*a* and the female thread member 4*b*. At this time, the spring member 4*a* comes into contact with an end (a front end) of the rotation stop 2*b* in an end (a rear end) in an opposite side to the side in which the click projection 4*ab* is formed. Further, as shown in FIG. 3, the spring member 4*a* and the female thread member 4*b* can synchronously rotate in a state before the leading tube 1 is inserted to the main body tube 2*a*, and the spring member 4*a* and the female thread member 4*b* can move in the axial direction. Thereafter, if the leading tube 1 is inserted to the main body tube 2*a*, the leading tube 1 and the female thread member 4*b* are engaged in such a manner as to be synchronously rotatable, and the end (the rear end) in the opposite side to the side in which the opening portion 1*c* of the leading tube 1 is formed comes into contact with the surface in the front side of a step portion 4*bd* of the female thread member 4*b*. Therefore, the spring member 4*a* and the female thread member 4*b* are accommodated within the container main body 2 in such a manner as to be movable in the axial direction only within a contraction range of the spring portion 4*aa* of the spring member 4*a*.

Further, the spring member 4*a* and the female thread member 4*b* relatively rotate in the delivering direction on the basis of a relative rotation between the leading tube 1 and the container main body 2 in the delivering direction by the user, and a click engagement between the click projection 4*ab* and the click hole 4*ba* repeats an engagement cancellation and an engagement reset so as to generate a click sound "tick tick" and apply a click feeling to the user. Further, the click engagement mentioned above is employed for preventing a shape of the rod-shaped cosmetic material 6 having the smaller diameter from being lost by delivering little by little at a time of delivering the rod-shaped cosmetic material 6 having the smaller diameter on the basis of a rotational operation by the user.

In this case, in the shape of the click projection 4*ab* in accordance with the present embodiment, the spring member 4*a* and the female thread member 4*b* can not be relatively rotated in an inverse direction to the delivering direction (form a ratchet engagement), however, if the shape of the click projection 4*ab* is formed as a chevron shape, for example, the inclined surfaces are formed symmetrically right and left, it is possible to relatively rotate the spring member 4*a* and the female thread member 4*b* in an opposite direction to the delivering direction.

Further, in this case, in the male thread 3*a* of the moving body 3 and the female thread 4*bb* of the female thread member 4*b*, the pitches are between 0.25 mm and 1 mm, and more preferably between 0.5 mm and 1 mm, and they are formed at the groove number one. The pitch is made small (equal to or less than 1 mm) and the groove number is made small, for preventing the shape of the rod-shaped cosmetic material 6 having the smaller diameter from being lost at a time of delivering the rod-shaped cosmetic material 6 having the smaller diameter on the basis of the rotating operation by the user.

Further, the rod-shaped cosmetic material feeding container 100 in accordance with the present embodiment is structured, as shown in FIG. 1, FIG. 8 and FIG. 11, such that a airtight cap 7 for sealing the rod-shaped cosmetic material 6 accommodated in the leading tube 1 and having a volatility is detachably installed to the front portion of the leading tube 1. Further, an inner portion of the cap 7 is provided with an inner lid 7*a* which covers the leading end of the leading tube 1 and is installed to the leading end so as to come into close contact therewith, whereby it is possible to keep the cosmetic material 6 in a further sealed state. In this case, the cap 7 and the inner lid 7*a* are different members, however, a structure corresponding to the inner lid 7*a* may be formed in the cap 7. In this connection, the cap 7 and the inner lid 7*a* are formed, by a material which resists a volatile component, for example, a polyester group resin.

Next, a description will be given of one example of an assembling procedure of the rod-shaped cosmetic material feeding container 100 having the structure mentioned above, with reference to FIG. 1 to FIG. 3 and FIG. 11.

First of all, the rotation stop 2*b* is inserted from the rear end side of the main body tube 2*a*, and the rotation stop 2*b* is engaged so as to be immovable in the axial direction and be synchronously rotatable with respect to the main body tube 2*a*, whereby the container main body 2 is formed. Next, the moving body 3 is inserted to the inner side of the spring member 4*a* and the female thread member 4*b* which are engaged by click, the moving body 3 is screwed into a predetermined position by being connected by screw with the female thread member 4*b*, and the spring member 4*a*, the female thread member 4*b* and the moving body 3 are arranged so as to be accommodated within the container main body 2.

On the other hand, in the leading tube 1, the piston body 5 is set at an exact position (a position in an initial state) in the axial direction while being closely attached into the accommodating portion 1*a* of the leading tube 1 by using a rod-shaped body or the like. Next, a cosmetic material filling machine provided with a nozzle having a smaller diameter which can enter into the accommodating portion 1*a* of the leading tube 1 is prepared, the nozzle is entered into the accommodating portion 1*a* from the opening portion 1*c* in the leading end of the leading tube 1, and a cosmetic material (a rod-shaped cosmetic material forming material) in a melting state is directly injected so as to be filled while preventing the air from making an intrusion. Further, if the nozzle is drawn out of the accommodating portion 1*a* little by little and the cosmetic material is cooled and solidified, the rod-shaped cosmetic material 6 which is accommodated within the accommodating portion 1*a* in a closely attached manner can be obtained. At this time, the cosmetic material is also filled and formed in the concave portion 5*c* in the front side of the piston body 5.

Further, the rod-shaped cosmetic material feeding container 100 which can deliver the rod-shaped cosmetic material 6 can be obtained by inserting the leading tube 1 which accommodates the rod-shaped cosmetic material 6 and the piston body 5 in the inner portion, to the container main body 2.

In the rod-shaped cosmetic material feeding container 100 obtained as mentioned above, since the piston body 5 which is slidably inserted to the inner portion of the leading tube 1 in the closely attached state, and the moving body 3 in the rear side thereof are separated and are not engaged, it is possible to be directly filled with the cosmetic material in the melting state in the inner portion from the opening portion 1*c* of the leading end of the container, in a state in which only the piston body 5 is arranged at a predetermined position (a position in the initial state) within the leading tube 1, and it is possible to be filled with a fixed amount of cosmetic material in the front side of the piston body 5 without being affected by the moving body 3 (without depending on the moving body 3). As a result, the filling defect is prevented, and it is possible to achieve stability of a quality.

Further, since the concave portion 5*c* having the same shape as the concave portion 5*d* is provided also in the leading end surface of the piston body 5 at a time of assembling, the piston body 5 does not have any directionality and can be assembled even by inverting back and forth, and it is possible to improve an assembling property.

In the case that the position of the moving body 3 is positioned accurately at the predetermined position (the position in the initial state) or is deviated to the rear side within the container main body 2, the piston body 5 is not pressed forward by the moving body 3 in the case that the leading tube 1 is inserted into the container main body 2 so as not to come into question, however, for example, in the case that the leading tube 1 is inserted into the container main body 2 even if the moving body 2 is deviated to the front side, the moving body 3 comes into contact with the piston body 5 and the spring portion 4*aa* of the spring member 4*a* is contracted via the female thread member 4*b*, whereby the moving body 3 moves rearward and is positioned at the predetermined position (the position in the initial state) so as not to come into question.

In the rod-shaped cosmetic material feeding container 100 having the structure mentioned above, if the user relatively rotates the leading tube 1 and the container main body 2 in the delivering direction, the leading tube 1 and the female thread member 4*b* are synchronously rotated, and the container main body 2, the spring member 4*a* and the moving body 3 are synchronously rotated, whereby a screwing action of the female thread 4*bb* of the female thread member 4*b* and the male thread 3*a* of the moving body 3 works, the moving body 3 moves forward in the delivering direction, and the leading end 3*c* of the moving body 3 moves forward into the concave portion 5*d* in the rear side of the piston body 5 so as to come into contact. In the case that the piston body 5 and the moving body 3 are accurately positioned at the predetermined position (the position in the initial state), the leading end 3*c* of the moving body 3 moves forward into the concave portion 5*d* of the piston body 5 so as to come into contact from the beginning.

Further, since the leading end 3*c* of the moving body 3 moves forward into the concave portion 5*d* in the rear side of the piston body 5 so as to come into contact as mentioned above, the piston body 5 moves forward straightly without being twisted by the concave and convex portions 5*d* and 3*c* mentioned above, at a time of pushing out the volatile rod-shaped cosmetic material 6 which is closely attached into the leading tube 1 and has a great resistance on the basis of the forward movement of the piston body 5, and the rod-shaped cosmetic material 6 is well pushed out.

Further, at this time, since the piston body 5 has each of the annular convex portions 5*a* and 5*b* which are closely attached to the inner portion of the leading tube 1 so as to slide, at the positions which are spaced in the axial direction of the outer peripheral surface thereof, the piston body 5 further moves forward straightly without being twisted, on the basis of these annular convex portions 5*a* and 5*b*, and the rod-shaped cosmetic material 6 is better pushed out.

Further, the rod-shaped cosmetic material 6 appears from the opening portion 1*c* in the leading end of the leading tube 1, and is set to be in condition.

Further, if the movement in the delivering direction of the moving body 3 is further carried out, the screw connection between the female thread 4*bb* and the male thread 3*a* is cancelled, and the moving body 3 comes to a delivering limit (a forward moving limit). In this case, even if the screw connection is cancelled, the spring member 4*a* pushes up the female thread member 4*b* in the axial direction on the basis of the elastic force of the spring portion 4*aa*, and the female thread 4*bb* and the male thread 3*a* are immediately restored to the screw connection. In this case, since the projection 3*d* (refer to FIG. 6) extending in the axial direction of the moving body 3 is engaged with the click hole 4*ba*, and the moving body 3 and the female thread member 4*b* are engaged so as to be synchronously rotatable before the screw connection between the female thread 4*bb* and the male thread 3*a* is cancelled, whereby it is possible to achieve the delivering limit (the forward moving limit) of the moving body 3.

Further, for example, at a time of newly replacing with the leading tube 1 which accommodates a new rod-shaped cosmetic material 6 after finishing with the rod-shaped cosmetic material 6, the new leading tube 1 may be inserted to the container main body 2 after drawing the leading tube 1 out of the container main body 2, thereafter relatively rotating the female thread member 4*b* and the moving body 3 in a reverse direction to the delivering direction so as to return the moving body 3 to the initial position as shown in FIG. 1 and FIG. 3.

In accordance with the rod-shaped cosmetic material feeding container 100 mentioned above, since the rod-shaped cosmetic material is set to the rod-shaped cosmetic material 6 including the cosmetic volatile oil and the diameter thereof is set to the small diameter between 0.9 mm and 2.5 mm, it is possible to draw a narrow line such that it is drawn by an ink brush, a comb or the like, it is possible to achieve a small diameter of the container, it is possible to spread the cosmetic material after being applied with a smooth use feeling, and an excellent portability is obtained such as a pencil type.

Further, since the rotation stops 3*b* and 2*bc* constructing the delivering mechanism are provided respectively in the rear end outer periphery of the moving body 3 and the inner periphery of the container main body 2, it is possible to further achieve the small diameter of the container.

Further, since the rod-shaped cosmetic material 6 is delivered little by little on the basis of the click engagement, the thread pitch for delivery is set between 0.25 mm and 1 mm, and the groove number is set to 1, it is possible to deliver without losing the shape of the rod-shaped cosmetic material 6 having the smaller diameter.

Further, it is possible to securely prevent the volatilization of the rod-shaped cosmetic material 6 having volatile by the airtight cap 7 which is installed to the leading end of the leading tube 1.

FIG. 12 is a longitudinal cross sectional view showing an initial state of a rod-shaped cosmetic material feeding container in accordance with a second embodiment of the present invention.

The rod-shaped cosmetic material feeding container 200 in accordance with the second embodiment is different from the rod-shaped cosmetic material feeding container 100 in accordance with the first embodiment in a point that the leading tube 1 and the main body tube 2*a* are engaged so as to be synchronously rotatable and form the container front portion, the main body tube 2*a* and the rotation stop 2*b* constructing the container main body 2 are engaged so as to be relatively rotatable, and the rotation stop 2*b* forms the container rear portion.

In other words, in the illustrated rod-shaped cosmetic material feeding container 200, the rotation stop 2*b* is relatively rotated with respect to the leading tube 1 and the main body tube 2*a*, whereby the moving body 3 is moved in the delivering direction, and the piston body 5 is moved in accordance with the movement of the moving body 3, whereby the rod-shaped cosmetic material 6 is delivered from the opening portion 1*c* of the leading tube 1.

As a structure of the rod-shaped cosmetic material feeding container 200 as mentioned above, a protrusion (not shown) which can be rotated so as to be synchronous with the main body tube 2*a* is provided in an axial direction of an outer periphery of the rear portion which is inserted into the main body tube 2*a* of the leading tube 1, and a protrusion (not shown) for engaging with the protrusion provided in the outer peripheral surface of the rear portion of the leading tube 1 is provided in an axial direction of an inner peripheral surface of the front portion of the main body tube 2*a*, in comparison with the structure of the rod-shaped cosmetic material feeding container 100 in accordance with the first embodiment mentioned above. In this case, the other structure which can obtain the same effect can be employed in place of the protrusion as mentioned above, as long as the leading tube 1 and the main body tube 2*a* operate in such a manner as to be synchronously rotatable.

Further, as the structure of the rod-shaped cosmetic material feeding container 200, the protrusion 2*ac* is not provided in the inner peripheral surface of the rear portion of the main body tube 2*a*, and the protrusion 2*bb* is not provided in the outer peripheral surface of the rotation stop 2*b*, in comparison with the structure of the rod-shaped cosmetic material feeding container 100 in accordance with the first embodiment mentioned above. Further, the rotation stop 2*b* of the rod-shaped cosmetic material feeding container 200 is formed in such a shape that a rear portion thereof protrudes in an axial direction, in comparison with the rotation stop 2*b* of the rod-shaped cosmetic material feeding container 100, as illustrated, and is formed as the shape mentioned above for easily gripping the rotation stop 2*b*.

Further, as mentioned above, since the rotation stop 2*b* is structured such as to relatively rotate with respect to the leading tube 1 and the main body tube 2*a*, the spring member 4*a* and the female thread member 4*b* are synchronously rotated while keeping the engagement. In this case, the rear end of the spring member 4*a* and the leading end of the rotation stop 2*b* may be structured such that they can be engaged by click, as long as a click function is provided.

In the rod-shaped cosmetic material feeding container 200 having the structure mentioned above, since the other structures are the same as the rod-shaped cosmetic material feeding container 100, the achieved operations and effects are the same.

FIG. 13 is a longitudinal cross sectional view showing a rod-shaped cosmetic material feeding container in accordance with a third embodiment of the present invention.

The rod-shaped cosmetic material feeding container 300 in accordance with the third embodiment is different from the rod-shaped cosmetic material feeding container 100 in accordance with the first embodiment and the rod-shaped cosmetic material feeding container 200 in accordance with the second embodiment in a point that a grip portion 9 for gripping a chip 8 is provided in the rear end side of the rotation stop 2*b* of the container main body 2. In this case, the chip 8 is used for gradating or spreading the cosmetic material 6 which is applied to the subject.

Further, the other structures are the same as the rod-shaped cosmetic material feeding container 100 or the rod-shaped cosmetic material feeding container 200, and the achieved operations and effects are accordingly the same. In this case, FIG. 13 shows a structure in which the grip portion 9 and the chip 8 are added to the rod-shaped cosmetic material feeding container 100 as one example.

In this case, in each of the embodiments mentioned above, the click projection 4*ab* and the click hole 4*ba* are engaged by click (including a ratchet engagement), however, it goes without saying that the click hole 4*ba* may be changed to the click projection, and the click projections carry out the same click engagement as mentioned above.

What is claimed is:

1. A rod-shaped cosmetic material feeding container comprising:

a container front portion which is formed as a tubular shape being open in both ends;

a rod-shaped cosmetic material formed by being directly filled with a cosmetic material in an inner portion of the container front portion, and closely attached to the inner portion;

a piston body provided to be slidable in said inner portion of the container front portion in a closely attached state;

a container rear portion which is relatively rotatable with respect to said container front portion;

a moving body which is arranged in a rear side of said piston body within the container rear portion and is provided with a male thread in an outer periphery at one end and further provided with an outer peripheral rotation stop at an opposite end; and a female thread which is provided within said container rear portion and is connected by screw to said male thread;

wherein said rod-shaped cosmetic material feeding container is structured such that if said container front portion and said container rear portion are relatively rotated in a feeding direction, a screwing action between said male thread and said female thread works, said moving body moves forward, and said rod-shaped cosmetic material appears from an opening portion in a leading end of said container front portion in accordance with a forward movement of said piston body, and wherein said piston body and said moving body are separated so as not to be constrained to each other;

wherein said piston body is provided in a rear end surface thereof with a concave portion which is concaved toward a front side, and wherein said moving body is provided in a leading end surface thereof with a convex portion which enters into said concave portion so as to come into contact therewith; and wherein said piston body is also provided in a leading end surface thereof with a concave portion which is concaved toward a rear side and has the same shape as said concave portion which is concaved toward the front side.

2. A rod-shaped cosmetic material feeding container as claimed in claim 1, wherein said piston body has an annular convex portion which is closely attached to said inner portion of the front portion of said container so as to slide at each of positions which are spaced in an axial direction of an outer peripheral surface thereof.

* * * * *